US005350158A

United States Patent [19]

Whellock

[11] Patent Number: 5,350,158

[45] Date of Patent: Sep. 27, 1994

[54] METALLURGICAL LANCE AND METHOD OF COOLING THE LANCE

[75] Inventor: John G. Whellock, Denver, Colo.

[73] Assignee: Mincorp Limited, Englewood, Colo.

[21] Appl. No.: 39,287

[22] PCT Filed: Oct. 30, 1991

[86] PCT No.: PCT/GB91/01902

§ 371 Date: Apr. 19, 1993

§ 102(e) Date: Apr. 19, 1993

[87] PCT Pub. No.: WO92/07965

PCT Pub. Date: May 14, 1992

[30] Foreign Application Priority Data

Oct. 31, 1990 [GB] United Kingdom ..... 9023716

[51] Int. Cl.[5] ..... C21C 5/46

[52] U.S. Cl. ..... 266/46; 266/225; 266/270

[58] Field of Search ..... 266/46, 225, 270

[56] References Cited

U.S. PATENT DOCUMENTS

| | | | |
|---|---|---|---|
| 3,310,238 | 3/1967 | Bryant et al. | 266/225 |
| 3,828,850 | 8/1974 | McMinn et al. | 165/109 |
| 4,235,173 | 11/1980 | Sharp | 266/194 |
| 4,303,230 | 12/1981 | Bleloch | 266/270 |
| 4,792,126 | 12/1988 | Nagy et al. | 266/270 |

FOREIGN PATENT DOCUMENTS

| | | | |
|---|---|---|---|
| 902065 | 7/1985 | Belgium . | |
| 0012537 | 6/1980 | European Pat. Off. . | |
| 0223991 | 6/1987 | European Pat. Off. . | |
| 48609 | 9/1986 | Japan | 266/46 |
| WO80/01000 | 5/1980 | PCT Int'l Appl. . | |
| 1356299 | 6/1971 | United Kingdom . | |
| 1318486 | 5/1973 | United Kingdom . | |
| 1324226 | 7/1973 | United Kingdom . | |
| 1599366 | 9/1981 | United Kingdom . | |
| 2137742A | 3/1984 | United Kingdom . | |

*Primary Examiner*—Melvyn J. Andrews

*Attorney, Agent, or Firm*—Seidel, Gonda, Lavorgna & Monaco

[57] ABSTRACT

A metallurgical lance incorporates an indirect cooling system, separate from and independent of the reactants which are fed through a center passageway (12) to a melt, bath or the like. An outer passageway (10) extends around the center passageway (12) and its outer wall (14) is exposed to heat flux. A coolant flows through the outer passageway (10). Auxiliary means (22) are positioned within the outer passageway (10) to enhance the take-up of heat from the outer wall (14). The coolant is a two-phase mixture, preferably gas and water. The auxiliary means may be a helical fin (22) or a wire packing within the coolant flow path. Enhanced cooling is achieved by (a) the extended metal surface area provided by the auxiliary means, and/or (b) surface evaporation of a film of liquid deposited on the auxiliary means and/or on the inside of the outer wall (14).

25 Claims, 4 Drawing Sheets

METALLURGICAL LANCE AND METHOD OF COOLING THE LANCE

This invention relates to metallurgical apparatus and processes, and is particularly concerned with lances for use in metallurgical processes, and with methods of cooling such lances.

In many metallurgical applications which utilise high temperature furnaces or reactors or molten salt baths, there is a requirement to introduce heat through combustion or the feed of reactants. The furnace environment is subject to very high heat flux.

Most conventional furnaces have combustion systems which are often refractory-lined combustion chambers, in which gaseous, liquid or solid fuels are combusted together with air or an oxidant such as oxygen or oxygen-enriched air. Normally, a combustion system is mounted in the freeboard or combustion space above the working bath or melt and the heat flux by radiation from the furnace environment back to the combustion chamber is accommodated by virtue of the flow of the combustion reactants through the burner together with the use of suitable refractory materials or by using water-cooled metals for the combustion parts.

In other metallurgical operations it is desirable to contact the melt more efficiently and use the combustion products or potential reactants within the metallurgical bath, both augmenting heat and mass transfer. In this instance, the combustion system has to accommodate the heat flux from the melt itself, plus potential corrosive effects due to the chemistry of the slag, matte or metal that is present. Further, there is a need to overcome any back pressure effects due to the hydrostatic head created by the melt.

In the steel industry it is common to use lances for the injection of gases or reagents into the melt. Such lances frequently involve the use of refractory-coated steel tubes down which a gas such as nitrogen, argon or oxygen passes at high velocity (with or without solid reagents). These lances eventually corrode, melt or fail and are considered consumable. In another type of furnace, common in the non-ferrous metal industry, it is desirable to contact reactants of a gaseous nature with the melt. Specially designed tuyeres, or tubes, are used which are mounted flush with the refractory of the vessel to minimise the impact of the corrosive melt and its temperature on the materials of construction of the infection tube itself. Alternatively, some metallurgical converters use water-cooled lances, but generally only in the free-combustion space, not in the submerged melt, or sometimes submerged but flush with the refractory wall. Traditionally, there has been a resistance to the use of water cooling for submerged lance devices, especially where they actually enter the melt, due to the potential hazard from fracture of a cooling jacket and the consequent vapour explosion. Yet, to accommodate the high heat fluxes within a melt, it is necessary to ensure that the lance materials are adequately cooled. One way of achieving this has been to use a cooling oil which passes through a metal annulus and both cools the metal of the lance and enters the melt. The latent heat of evaporation of the oil creates local cooling of the injector or nozzle. Another alternative for such an injector/nozzle or lance is to use methane gas as a coolant. This so-called shrouded-tuyere arrangement takes advantage of the cooling gas flow through a narrow annulus at high velocity directly into the melt. One obvious disadvantage of this is that the melt is contaminated with the oil or methane gas, which may not always be desirable. Another disadvantage, in the case of oil as a coolant, is that pyrolytic cracking or coking of the injector assembly may occur with subsequent blockage and ultimate failure of the assembly. Careful arrangements have to be made to ensure that there is no back flow of the melt into the gas or oil passageways and elaborate mechanical arrangements have to be made for their start-up.

Combinations of ceramic-coated cooling systems have been applied where water is used in either a jacket or a coil to ensure the integrity of the metal (steel) inner surfaces. This arrangement has the potential risk of fracture of the ceramic and leakage and subsequent explosion of the cooling fluid within a melt. To obviate some of these problems, totally gas-cooled lances have been developed in which the reactants, typically air and oil, or air and combustible gas or solid fuel, are passed through the lance directly into a melt. These lances have been applied in a number of non-ferrous metals applications where the slag itself forms a refractory coating on the lance. This approach is valid when the slag-forming constituents of the melt are satisfactory for making an adhesive slag with suitable thermal properties, but leads to a number of significant disadvantages. These are:

1) A molten, preheated slag bath has to be established in order that the splashing on the lance can generate a suitable slag coating.
2) The cooling gases, which are also the reactants or source of combustion, cannot be turned down, i.e. reduced, significantly as high flow and high velocity are necessary to ensure that the metal of the lance is maintained cool enough not to fuse with the melt or disintegrate (or else the lance has to be retracted from the melt). A typical turn-down is only 30–40 per cent.
3) Significant oxygen enrichment of the air or oxidising gas is not viable since the mass flow through the lance is then insufficient to cool the lance wall below its oxygen ignition temperature.
4) The total mass flow exchange rate in the melt can be excessive, leading to an inordinate amount of splashing, potential entrainment of product or valuable material and major accretion of slag on the walls and exit duct.
5) The lance becomes a cumbersome entity to handle in and out of a vessel. Since the thickness of slag coating and rate of accretion cannot be predetermined, adequate clearances have to be provided for extraction of the lance, which can lead to problems of environmental containment when smelting non-ferrous metals.

One object of the present invention is to avoid these major disadvantages and provide a means of introducing heat or reactants into a melt in the submerged mode without significant problems from either turning down the flow or operating with oxygen enrichment at high levels, i.e. at 40% v/v oxygen or above. This is not to say that the lance may not be used with air or any oxygen enrichment level above 21%. The present invention further avoids the hazard of using submerged water-cooled surfaces and can therefore be used for penetrating a melt from above, below or from the side as appropriate. The containment means for injecting reactants are variously termed lances, tuyeres, injectors or pipe reactors. Hereinafter, the term "lance" will be used to denote any or all of these devices. The term "lance" is also to be understood as including a "burner". A lance of this type does not need to be used in a submerged mode but could be used in the freeboard, for example for heating up a furnace. The lances of the present invention can also be used in a dual purpose manner, for example for heating in the freeboard and then being submerged for injection of reactants or subsequent submerged combustion firing.

In accordance with the invention there is provided a metallurgical lance comprising an inner passageway through which reactants can be fed, an independent outer passageway which extends around the inner passageway and which has wall surfaces arranged to be exposed to heat flux, the outer passageway being arranged to have a coolant flow therethrough, and auxiliary means positioned within the outer passageway to enhance the take-up of heat from its wall surfaces to cool the same.

Preferably the auxiliary means causes non-linear flow of the coolant in the outer passageway.

The auxiliary means may provide an extended metal surface area within the outer passageway on which evaporative cooling can take place.

The auxiliary means may induce a flow of the coolant outwards towards an external wall of the passageway which is subjected to the greatest heat flux.

The auxiliary means preferably comprises packing means within the outer passageway.

In accordance with the invention there is also provided a method of cooling a metallurgical lance which comprises feeding reactants through an inner passageway thereof, passing a coolant through an independently operated outer passageway which extends around the inner passageway and which has wall surfaces exposed to heat flux, and positioning auxiliary means within the outer passageway to enhance the take-up of heat from its wall surfaces to cool the same.

Preferably the method includes cooling the wall surfaces by providing an extended metal surface area within the outer passageway.

Preferably, the method includes inducing surface evaporation of coolant within the outer passageway to cause cooling of the wall surfaces thereof.

The lance has no need to take advantage of cooling provided by mass flow of reactants, products or cooling gases which are exiting the end of the lance and passing directly into the furnace environment or melt. The lance operates with a minimum total liquid hold-up so that water vapour or rapid liquid evaporation explosion through a ruptured jacket is highly unlikely.

Two methods of achieving laminate evaporation are preferred. The first is centrifuging droplets by virtue of their larger mass to form a layer at the region where heat transfer is at a maximum and constantly replenishing this film by new droplets introduced with the carrier gas. The second is the provision of an interfacial wire, ribbon or mesh packing made of a conductive metal such as copper, aluminium, silver, iron or steel which disrupts and redistributes the boundary layer flow conveying heat rapidly to the bulk or center of the fluid flowing. Laminate evaporation on this extended surface enhances the cooling rate by an order of magnitude compared with the cooling obtainable with the carrier gas alone.

If an extended internal surface area is provided, this may be provided by an interfacial wire, ribbon or mesh packing made of a conductive metal such as copper, aluminium, silver, iron or steel which is in intimate contact with the outside wall.

The surface area provided by this insert is preferably at least twice the external superficial area of the lance in the region to be cooled. The lance has no need to take advantage of cooling provided by means of mass flow of reactants, products or cooling gases which are exiting the end of the lance and passing directly into the furnace environment or melt.

The reactants passing down the central pipe or pathway of the lance may be preheated by operating the outer cooling circuit in countercurrent flow.

Although often it is not necessary to operate with any oxidant other than air, sometimes the reactants may contain oxygen or air with high levels of oxygen enrichment whereby the cooling circuit is operated in co-current flow so as to minimise inner metal wall temperatures below potential ignition condition having regard to the oxygen level.

The lance can be operated in a submerged melt in a molten metal, slag or liquid at a high temperature with the external metal cooling surfaces kept substantially below 450° C. or a temperature selected having regard to the mechanical properties and temperature corrosion possibility of the metal within the melt.

The carrier gas may be any gas with a liquid such as water in the ratio range of 0.2 kg to 2 kg of water per kg of gas and where the carrier gas velocity is always significantly in excess of 20 m/s. Other ratios may be more appropriate where the liquid is other than water.

The lance may be used for injection of reactants or combustion products directly into a molten bath or furnace environment wherein a turn-down ratio of up to 5:1 can be accommodated.

In a preferred process, heat is recovered for use externally, using an open or closed circuit, with a condenser, heat exchanger or turbine expander.

The cooled lance(s) as described above provide substantially all of the fuel, reactant or combustion input in submerged mode or one can use one or more such lances to augment heat and mass transfer within a molten bath by operating submerged and by which up to 100 per cent oxygen can be injected if necessary.

The present invention makes use of considered safety limits for cooling circuits operated in indirect mode whereby the heat flux occasioned by transfer directly through the metal wall of the tube of the lance is quickly dissipated to an extended surface (inside) which is cooled by a flowing fluid. The extended surface may be a conductive metal wire, ribbon or fin inside a jacket or coil. The effective sensible heat of the cooling gas can be substantially augmented by finely divided droplets of water (or liquid) which partially or totally evaporate. The loading of liquid in the gas stream and the velocity are selected so that there is no significant inventory, accumulation or possibility of liquid pocketing in the jacket or coil.

Heat fluxes approaching burn-out conditions can be accommodated by this means while maintaining the mechanical integrity of the lance.

The method provides absolute protection for firing-up a combustion lance, preheating a vessel, and generating a melt before any slag protection or coating can be or is achieved. By virtue of the fact that the metal external wall is well below the fusion point of most slags, frozen slag will adhere naturally to the surface. Unlike the direct gas-cooled lance however, the adhesion of this slag coating does not defend on a substantial flow of gases or reactants into the melt, but when operating the lance in submerged mode it is necessary to maintain some exit velocity from the internal gas pathway of the lance to prevent blockage from frozen slag or bath material. However, it is only necessary to overcome, by some relatively small margin, the back pressure of the slag or melt comprising the bath material which is directly related to its density and the depth of submergence of the end of the lance. Depending on the application, metal temperatures can be held in a region ranging from 200° to 450° C., which is adequate for most stainless steels or relatively low-cost metals without any ceramic coating. This is not to say that a refractory sleeve or coating could not be applied to the outside of the metal jacket, but this is generally unnecessary.

The process of this invention preferable uses a concentric, coaxial, metallurgical lance which comprises an outer jacket arrangement containing internal metal extended surfaces which incorporates a return passage for the cooling fluid which is operated totally independently of the inner pathways through which reactants or combustion products are introduced into the metallurgical melt. Although the outer surface of the lance is preferably a circular cross-section tube, alternative geometries and arrangements are possible including a spirally wound coil (with internal extended metal surface), as long as provision is made for introduction of the cooling gas and for its exit without entering or contaminating the metallurgical melt or furnace atmosphere. This is not to say that the coolant could not enter the furnace environment or indeed the melt, but the cooling circuit would normally be discharged outside the furnace.

An object of the invention is to provide an indirect cooling circuit for ensuring the integrity of the jacket material (principally metal) for conditions where there is a need to alter the reactant injection rate or the need to turn-up and turn-down the fuel rate with or without oxygen within the furnace or its melt. It is not easy to provide for these heat fluxes and adequate rate of transfer away from the jacket metal into the bulk of the cooling medium to safeguard the metal from burnout when using gas coolants. Cooling medium flow rates, if gases, tend to be too high for economic design and operation. By the use of an extended internal surface in the jacket, particularly in the regions of the highest heat flux, the heat is transferred into the bulk of the cooling fluid which contains finely divided droplets of water and films on the heated surfaces. At any one time, the total quantity of evaporating liquid (typically water) in the gas stream (typically air) is minimal, but it is nevertheless sufficient to provide the evaporative heat transfer surface area and remove enough heat. A thin film of liquid, e.g. water, is generated on the interfacial area and/or at the inside of the metal wall where the heat transfer is at a maximum.

In order that the invention may be more fully understood, a number of embodiments in accordance with the invention will now be described by way of example and with reference to the accompanying drawings, in which.

Figure 1:
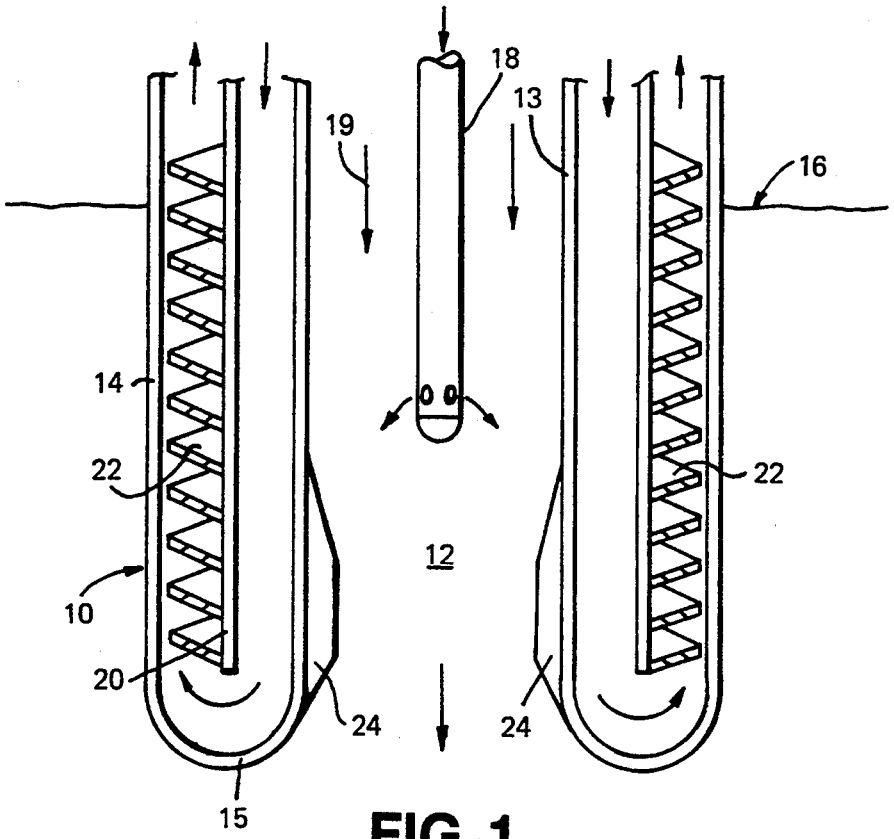
FIG. 1 is a partial sectional view through a first embodiment of lance in accordance with the invention.

Referring first to FIG. 1, this shows the tip end of a lance. The lance comprises an annular jacket 10 which defines a central passage 12 therethrough. The jacket has a cylindrical inner wall 13 and a cylindrical outer wall 14 connected by a curved end wall 15. It is through the central passage 12 that gaseous and/or liquid and/or solid matter is directed into the melt, the surface of which is indicated at 16. Above the melt surface is the combustion space, otherwise known as the freeboard. In the illustrated embodiment a pipe 18 is positioned coaxially within the passage 12. The pipe 18 has a plurality of exit holes adjacent to its tip. By way of example, a flow of natural gas is directed through the pipe 18 and a mixture of air and oxygen flows through the passage 12 around the pipe, as indicated by arrows 19.

Positioned within the jacket 10, substantially midway between walls 13 and 14, is a cylindrical divider 20 which stops short of the end wall 15 to define respective down-flow and up-flow passages on opposite sides of the divider. Attached to or integral with the outer surface of the divider 20 is an annular helix 22. The helix is inclined in the manner shown, i.e. with the flow. The length of the helix 22 would normally correspond to the zone within the melt (submersible part of the lance) where the highest heat transfer flux is experienced. A mixture of air and water is normally used as the coolant in the jacket 10. The annular helix 22, the fins of which extend into close proximity to the outer jacket wall 14, creates a film of evaporable water on the internal surface of the outer jacket wall by a centrifugal action. Droplets of water are flung to the outer wall of the jacket to maintain micro-droplets and/or a thin evaporable film, due to their heavier nature relative to the carrying air and/or any steam that has already evaporated. This also applies to conditions on the curved end wall 15 at the return bend at the tip of the lance. Typical water to gas (air) ratios for the coolant are in the range of 0.2 to 2 kg/kg of carrier gas and are preferably in the range of 0.5 to 0.9 kg/kg having regard to the ultimate retention of liquid and the transient time of the coolant within the jacket.

The design configuration of the central passage of the lance is largely immaterial to the present invention. The embodiment shown in FIG. 1 includes a convergent/divergent nozzle 24 to accelerate the gas and oxidant phases into the melt. A number of other arrangements are possible. For example, the feeding system may include oil atomizing jets. An apertured plate for either gas, oxidant or both may be sited in the mouth of the central passage, to modify the mixing or swirl at the exit from the lance. Vanes to cause swirl or a metal, e.g. stainless steel, packing which can act as both a flame trap and a mixing zone, may be positioned in the mouth of the central passage. Other alternative internal arrangements are possible, enabling the introduction of solid phase reductants and/or combustible material into an air or oxidising gas stream. For circumstances where oxygen and oxidation in the melt are to be avoided, a reducing gas such as methane, or carrier gases such as nitrogen, argon or steam, together with particulate matter for reduction or chemical reaction, can be fed through the central passage.

Figure 2:
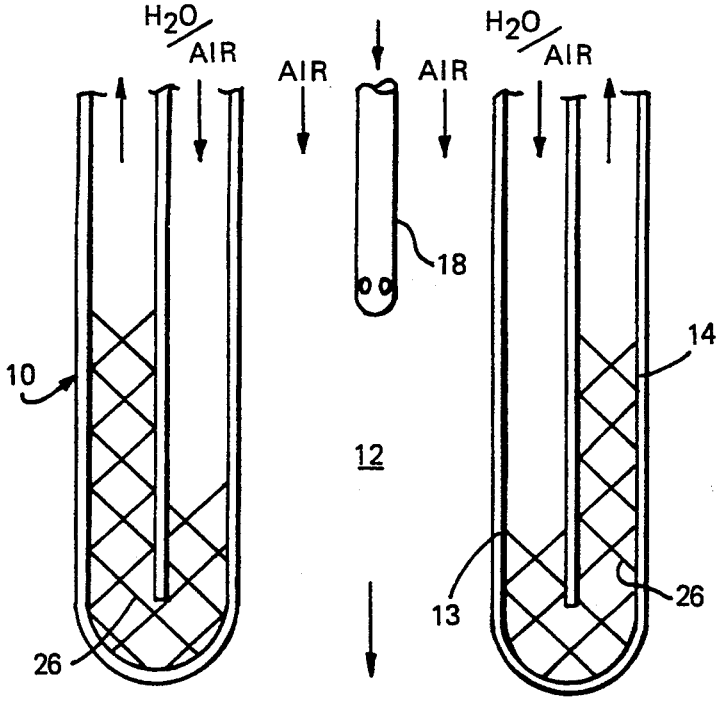
FIG. 2 is a partial sectional view through a second embodiment of lance in accordance with the invention.

In the second embodiment, as shown schematically in FIG. 2, a metal packing 26 is used in the outer annular zone and at the end of the jacket 10, instead of the helix 22. This is selected so as to provide a significant extended surface area of metal, within the jacket, approximately double that of the external surface area of the lance, and is open enough so that overall pressure drop across the packing is not excessive. The packing 26 can have a regular or a random configuration and is preferably of wire form in intimate contact with the jacket wall. The packing 26 provides an increased surface area for the deposition of water which can then evaporate from those surfaces, taking heat from the metal.

Figure 3:
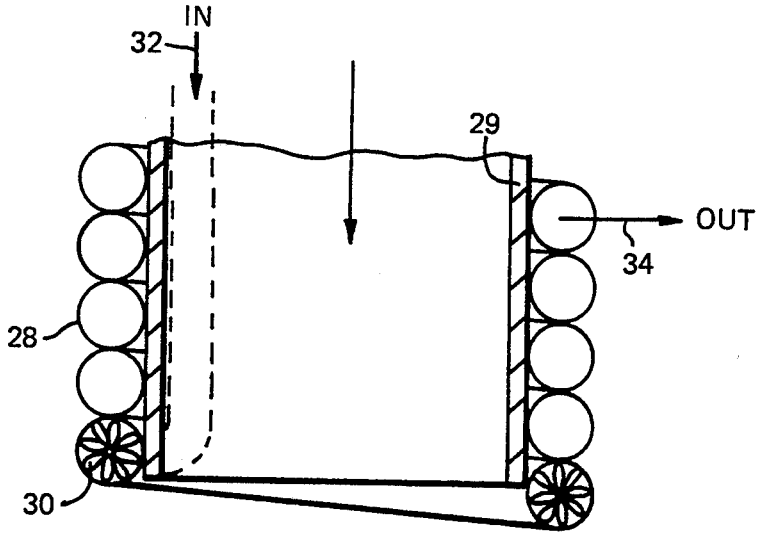
FIG. 3 is a partial sectional view through a third embodiment of lance in accordance with the invention.

FIG. 3 shows a coil 28, instead of a jacket, around a feed tube 29. The coil contains an extended-surface insert 30 in the bottom coil turn. The metal insert 30 can be made, for example, of spun or looped copper, aluminium, silver, iron or stainless steel wire (like a pipe cleaner) and is push fitted into the appropriate region of the coil 28 before it is wound as a coil. Only the "submerged" zone of the lance will normally need an extended-surface insert of this type. This may include the "splash zone" above the bath. The coolant is fed in as indicated by arrow 32 and the reactants/combustion mixture are fed down the feed tube 29. The coolant exits as indicated by arrow 34. The flow of the coolant through the coil centrifuges the liquid in the coolant to the wall where it is entrained and re-introduced into the bulk of the fluid repeatedly by the action of the insert 30 and the flowing fluid. Sensible heat gain in the cooling fluid as well as evaporation of a proportion or all of the deposited liquid serves to remove heat efficiently from the wall zone. Any exterior surface build-up of slag serves to mitigate this heat flux and is maintained and controlled by virtue of the coolant flow and the gas/liquid ratio.

It is also practical, in certain instances, to use a single fluid with high specific heat in conjunction with an extended surface inside the annular jacket or spiral coil arrangement. For example, fluids such as methane, steam, helium, hydrogen or carbon dioxide can be used, without the need for an evaporative mechanism requiring water or other liquid droplets, provided at least double the interfacial area is provided within the zone of the jacket requiring the extensive cooling. The mass flow of a single fluid needs to be significantly higher, but high coefficients can be obtained due to the extended surface and hither Reynolds number (turbulence) of the flowing fluid.

In either case, this cooling circuit operates independently of the introduction and flow rate of reactants or combustible mixture down the central passage of the lance and, as long as there is sufficient flow at the tip of the nozzle to keep the central passage clear from potential in-flow of slag, blockage will not occur and a high turn-down, of at least 3:1 and up to 5:1, can be achieved.

Figure 4:
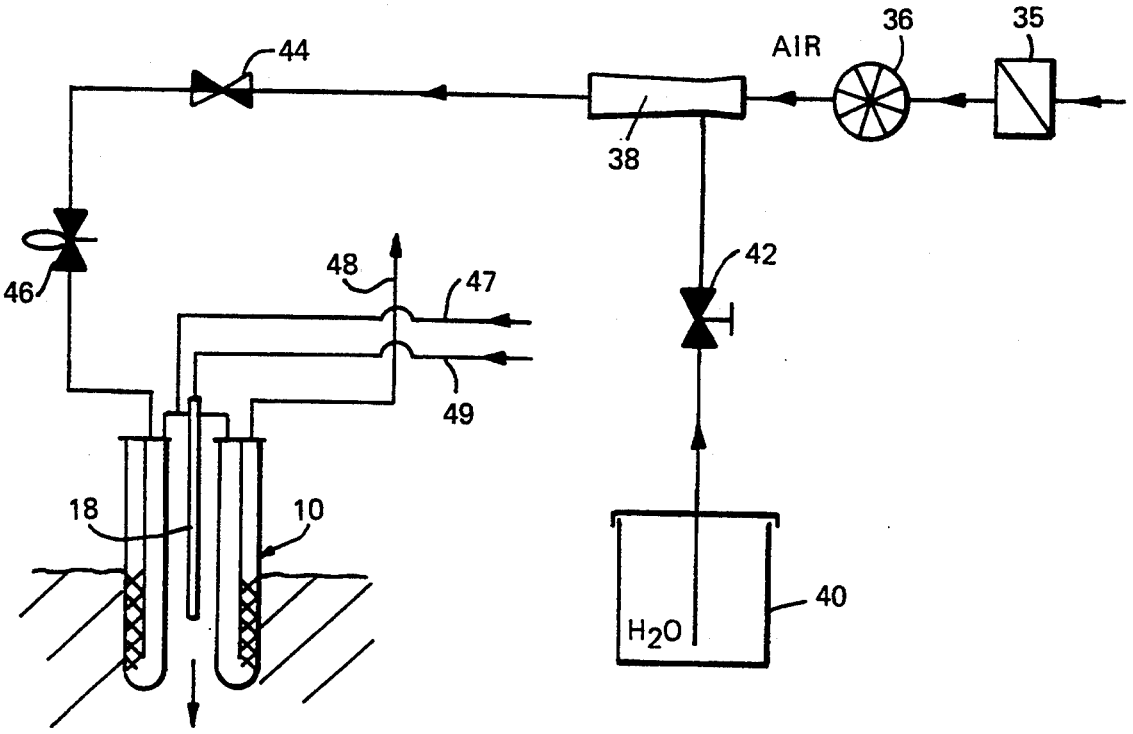
FIGS. 4 and 5 show two alternative cooling circuit arrangements.

In FIG. 4, a cooling circuit is shown with means for introducing droplets of water to the coolant. Air is pre-filtered in a filter 35 and is pressurised through a blower 36. A proportion of the available pressure is dissipated across a venturi or aspirator 38 which draws in water from a holding tank 40. This rate is adjustable and is a function of the flow rate and pressure loss in the venturi 38. A hand valve 42 can be used either to isolate the water supply or to trim the rate of addition. Maintenance of a constant head of water in the tank assumes consistent pressure of the supply. A simple ball-cock or valve arrangement is adequate for this although many other methods of level control are also possible. The water is high quality and preferably treated to prevent scale formation in the passageways of the lance cooling jacket. The air containing water droplets, which are fine by virtue of the pressure drop and turbulence created in the venturi 38, is piped through a check valve 44 and pressure relief valve 46 to the cooling passageways at the head of the lance. Air is fed (arrow 47) to the central passage 12 of the lance and natural gas (arrow 49) to the centre pipe 18. Heat picked up from the lance by the carrier gas and evaporated steam (plus any residual droplets) are vented from the lance as indicated by arrow 48 either to atmosphere or to a condenser (heat exchanger). From a safety point of view, it is desirable to minimise the number of fittings and restrictions to flow at the exit from the lance so that any vapour flashing may be easily and safely vented. Other safeguards can be incorporated to prevent water alone or air without water from being introduced into the lance cooling circuit.

Figure 5:
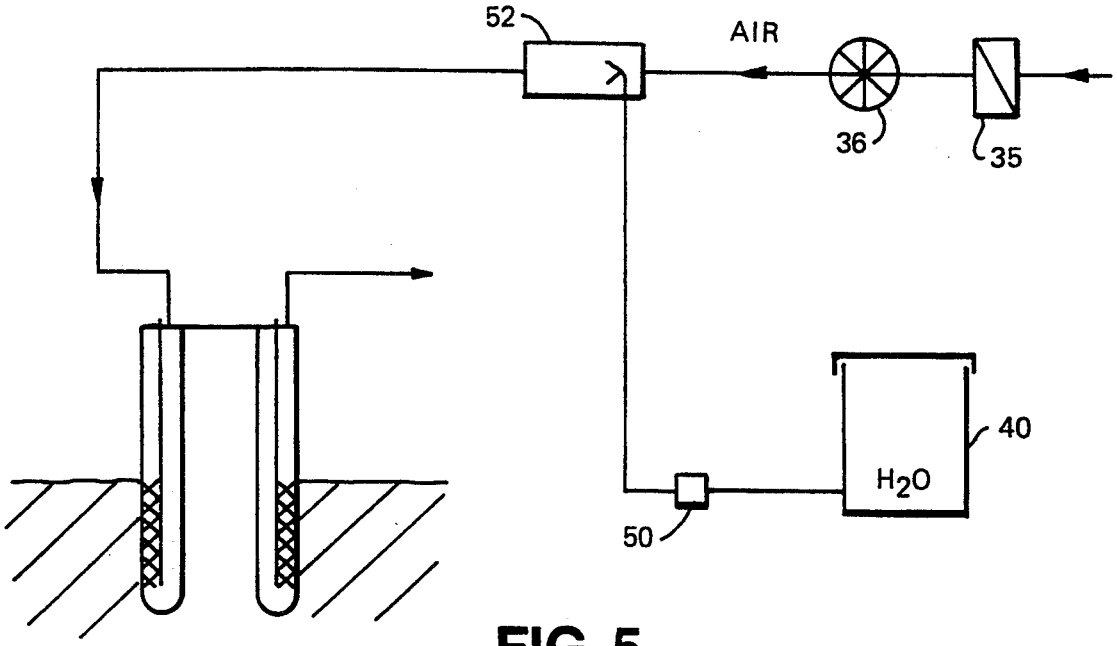

FIG. 5 shows an alternative cooling circuit where a metering pump 50 is used specifically to control the mass ratio of liquid to gas. A mixing chamber 52 is incorporated so that adequate dispersion of droplets into the carrier gas is achieved without excessive coalescence which might otherwise cause slugging flow. It is also possible to introduce atomising nozzles into the head or entrance zone of the lance, provided that safeguards are incorporated for adequate and even distribution of liquid droplets so formed and the liquid inventory in the lance is kept to a minimum. Other methods of introducing liquid and controlling gas/liquid ratio will be obvious to those familiar with the art.

Figure 6:
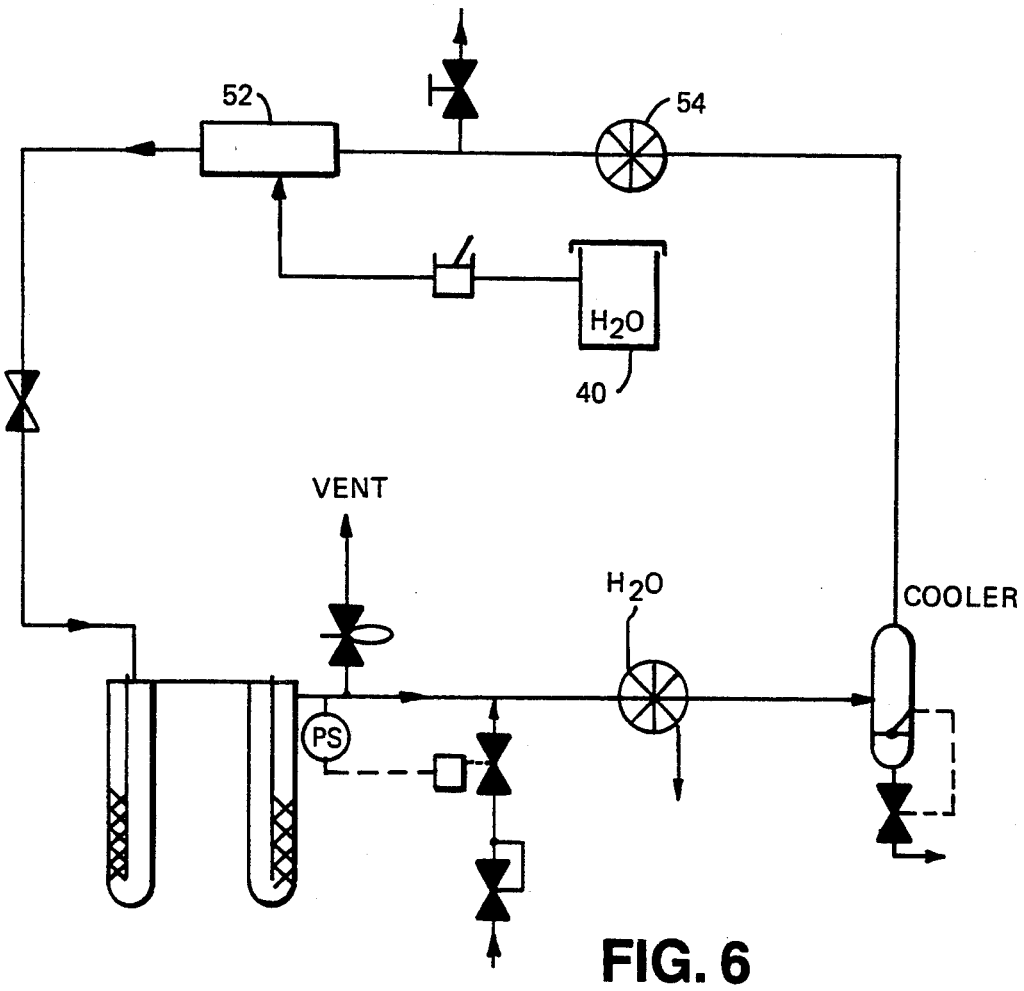
FIG. 6 shows a closed-loop cooling circuit.

FIG. 6 shows a closed loop cooling circuit in which the coolant carrier gas is methane (natural gas). Heat can be recovered from the circuit to an air or water cooled condenser or another heat transfer fluid for useful work if necessary. On sufficiently large applications, a turbine expander could be used. Principal features of the circuit are a closed pipeline, a compressor 54 to pump the methane around the pipeline, safe means for pressure relief or venting, and a water injection system comprising a constant head tank 40 and metering pump plus a mixing chamber 52.

Evaporation of droplets of water or liquid generates steam or other gaseous phase which, together with the methane and any original water or liquid droplets, exit the lance. The condensation of the steam is achieved by conventional heat exchangers or splash condensers followed by gas/liquid separation before recompression of the gas. The circuit is first vented with nitrogen to purge all the air (oxygen) before introducing methane (natural gas) from a bottled or mains supply at regulated pressure. Due to the higher specific heat of methane, roughly one half the flow rate as compared with air is required around the circuit to achieve the same duty, but a velocity in the cooling jacket of at least 20 m/s must be observed to prevent slugging of water or other liquid.

Figure 7:
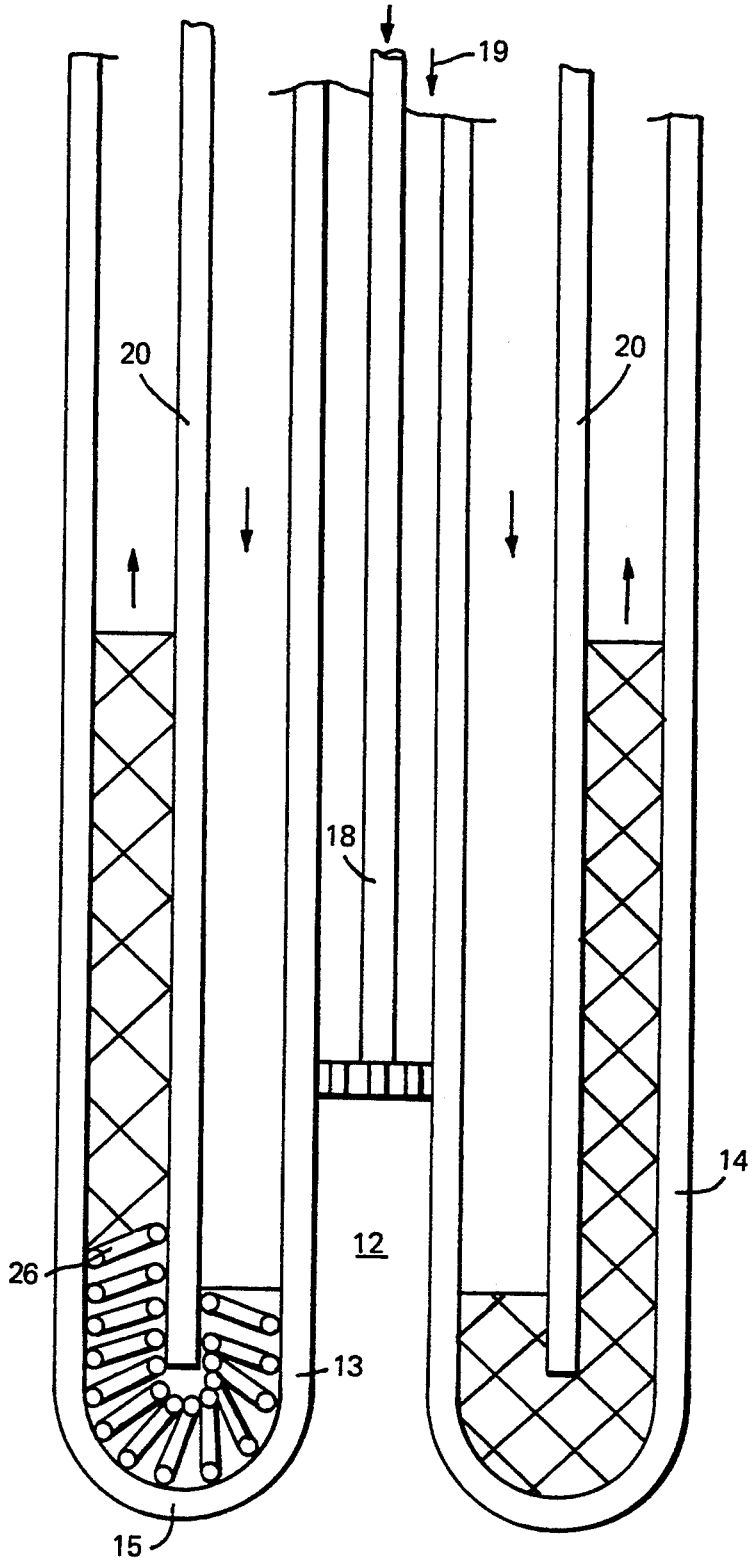
FIG. 7 is a partial sectional view through a further embodiment of lance showing additional internal details.

FIG. 7 shows the detail of the pathways inside an embodiment of lance. Depending on the use of the lance there are two possibilities for flow of the coolant media: either co-current flow with reactants down the core, i.e. coolant enters down the inner annulus and exits up through the outer annulus or, conversely, counter-current flow in which coolant first enters down the outer annulus and passes up out of the lance through the inner annulus. The arrows in FIG. 7 show the former. In co-current flow, the reactants in passage 12 are maintained at their coolest, which is important if high oxygen concentrations are employed in the inner core. With counter-current flow, some heat picked up in the outer annulus is transferred to the inner gas stream in passage 12 via counter-current heat exchange from the inner annulus 13 to the centre passage 12. Preheating of the centre passage gas to temperatures approaching the coolant medium temperature at the tip are possible by this means. This can be useful where no oxygen enrichment is used. The choice will depend on specific conditions.

In the example, the lance comprises an outer 2 inch stainless steel pipe 14 of Schedule 40 thickness, an inner baffle tube 20 of 1¼ inch Schedule 40 which has a clearance at the tip equivalent to the flow area of the annulus, and an inner wall 13 formed by a ¾ inch Schedule 40 pipe. Down the central passage 12 an oil or gas injection pipe 18 is also shown, but the details of this are of no special consequence here. The outer annulus is packed with a copper wire 26 of approximately 90 per cent free voidage and surface area of 250 $m^2/m^3$ for about 2 m length of the annulus including the 180 degree bend at the tip.

This lance is suitable for supplying air/oxygen and natural gas and their combustion products at approximately 150,000 kcal/h into a melt at a maximum of 1 m submerged depth. It could also be used for injection of air or oxygen or other gas alone into a melt.

The heat pick-up from the outer jacket is about 22,000 kcal/h at a melt temperature of 1300° C. By passing a mixture of air and water at a ratio of 1:0.8 w/w at ambient temperature, the maximum steel temperature of the outer annulus is 320° C. A flow rate of 40 kg/h of air and 32 kg/h of pre-treated water are necessary to control this temperature as the lance becomes submerged. The exit gas temperature (steam and air) from the outer annular zone for a lance exposed to a furnace environment for a length of 3.5 m is about 180° C. The packed zone 26 where laminate or film evaporation of water is created has approximately double the surface area of copper wire relative to the corresponding external surface of the outer tube. The overall operating pressure drop for this lance arrangement is about 40 kPa. The maximum liquid hold-up in the lance itself is minuscule and velocities are high enough (>20 m/s) that slugging of water cannot develop.

This embodiment is given by way of illustration only. A wide variety of combinations of gases and liquids and their respective flow rates may be employed. The liquid hold-up in the hot environment at any time is absolutely minimal, thereby minimising any risk of vapour explosion by failure or rupture of the wall.

The methods of the invention described above can also be used only for the submerged part or submersible part of the lance. In other words, the part of the lance that is in the freeboard above the melt (in the case of a vertically introduced lance), could have a conventional water cooled jacket arrangement, with a separate water cooling circuit. In this instance only the submersible tip which would be, say, 1 m long, would need to have the proposed cooling arrangement which would then be separate from the water jacket. While this is not quite as safe as having no water at all in the lance, it is quite common practice to use water-cooled lances in the freeboard combustion space of furnaces but not for immersion. If the water jacket were to fail, the water is not entrapped beneath molten slag or metal or bath material which is the principal cause of explosion hazard. The invention thus extends to the combination of a water-cooled top part of the lance with the methods as described above for the submersible tip.

Although as described above the liquid in the coolant is water, other liquids could be used. For example, one could use vaporising oils or organic products that would flash freely without leaving solid residues. Also, it is possible that the coolant could incorporate solid matter which would sublimate directly to the vapour phase, taking up heat by the endothermic reaction.

The lances of the present invention find application in many processes. These include:

- processes using the lance for submerged combustion smelting, refining or fuming;
- processes using the lance for precious metal refining and cupellation where the lance is used for heating, melting, smelting and air/oxygen blowing whether above or below the melt;
- processes using the lance for copper matte converting or refining of blister copper by injection of air/oxygen;
- processes involving the injection of reagents, reactants or reductants into a bath for slag cleaning or impurity elimination or toxic material treatment;
- processes using the lance for injection into a stationary, reverberatory, rotary, or semi-rotary furnace where gaseous, liquid or solid reductant is used for processing by oxidation or reduction of slag and/or matte and/or metal.

I claim:

1. A metallurgical lance comprising an inner passageway through which reactants can be fed, an independent outer passageway which extends around the inner passageway and which has wall surfaces arranged to be exposed to heat flux, the outer passageway defining an end portion which is subjected to the highest heat flux during use and being arranged to have a coolant flow therethrough, and auxiliary means located only within said end portion of the outer passageway to modify the coolant flow in said end portion to enhance the take-up of heat uniformly around the wall surfaces of said end portion to cool the same.

2. A lance according to claim 1, in which the auxiliary means causes non-linear flow of the coolant in the outer passageway.

3. A lance according to claim 1, in which the auxiliary means provides an extended metal surface area within the outer passageway on which evaporative cooling can take place.

4. A lance according to claim 1, in which the outer passageway has an internal wall surface and the auxiliary means induces a flow of the coolant outwards towards an external wall of the passageway which is subjected to the greatest heat flux.

5. A lance according to claim 4, in which the auxiliary means comprises helical fin means within the outer passageway extending from the internal wall surface towards the external wall surface.

6. A lance according to claim 1, in which the auxiliary means comprises packing means within the outer passageway.

7. A lance according to claim 6, in which the packing means comprises metal wire, ribbon or mesh distributed across the flow cross-section of the passageway over said end portion.

8. A lance according to claim 6, in which the packing means is of copper, silver, aluminum, iron or steel.

9. A lance according to claim 7, in which the packing means occupies about 10% of the volume of the passageway over said end portion.

10. A lance according to claim 6, in which the packing means provides an extended surface area which is at least twice the external surface area of the lance in the region to be cooled.

11. A lance according to claim 1, in which the outer passageway is within an annular jacket around the inner passageway, said jacket having a cylindrical divider therein to define an inner annular channel and an outer annular channel, said auxiliary means being positioned within said outer annular channel.

12. A lance according to claim 11, in which the auxiliary means is positioned also at the end of the divider at the tip of the jacket.

13. A lance according to claim 1, in which the outer passageway is within a coil would spirally around the inner passageway.

14. A method of cooling a metallurgical lance which comprises feeding reactants through an inner passageway thereof, passing a coolant through an independently operated outer passageway which extends around the inner passageway and which has wall surfaces exposed to heat flux, and circulating coolant through auxiliary means positioned only within the portion of the lance subjected to the highest heat flux during use to modify the coolant flow in that portion of the lance and thereby to enhance the take-up of heat from said wall surfaces to cool the same.

15. A method according to claim 14, in which the coolant flows in a non-linear manner through the outer passageway.

16. A method according to claim 14, which includes cooling the wall surfaces by providing an extended metal surface area within the outer passageway.

17. A method according to claim 14, which included inducing surface evaporation of coolant within the outer passageway to cause cooling of the wall surfaces thereof.

18. A method according to claim 14, in which the coolant is a two phase mixture.

19. A method according to claim 18, in which the coolant is a gas carrying droplets of liquid.

20. A method according to claim 19, in which the liquid is water.

21. A method according to claim 20, in which the ratio of water to gas is in the range 0.2 kg to 2.0 kg of water per kg of gas.

22. A method accord to claim 21, in which the droplets are induced to move in the outer passageway towards the outside of the passageway into contact with the walls which are subject to the greatest heat flux.

23. A method according to claim 14, in which the coolant comprises a gas having a flow velocity greater than 20 meters per second.

24. A method according to claim 14, in which the reactants passing down the inner passageway are preheated by operating the outer circuit with a countercurrent flow.

25. A method according to claim 20, in which ratio of water to gas is in the range of 0.5 kg to 0.9 kg of water per kg gas.

* * * * *